US005185490A

United States Patent [19]

Vandervoort

[11] Patent Number: 5,185,490

[45] Date of Patent: Feb. 9, 1993

[54] KEY GUIDE

[76] Inventor: Paul B. Vandervoort, 5223 Norcrest Ave., Carmichael, Calif. 95608

[21] Appl. No.: 708,468

[22] Filed: May 30, 1991

[51] Int. Cl.[5] ..... G10C 3/12

[52] U.S. Cl. ..... 84/436

[58] Field of Search ..... 84/433, 434, 435, 436

[56] References Cited

U.S. PATENT DOCUMENTS

| | | | |
|---|---|---|---|
| 821,533 | 5/1906 | Pekat | 84/434 |
| 2,117,002 | 5/1938 | Hammond | 84/423 |
| 2,675,728 | 4/1954 | Jewett | 84/424 |
| 2,675,729 | 4/1954 | Jewett | 84/424 |
| 3,693,492 | 9/1972 | Ohno | 84/436 |
| 3,736,831 | 6/1973 | May | 84/434 |
| 3,738,216 | 6/1973 | Slaats | 84/433 |
| 3,820,433 | 6/1974 | Hayashida | 84/436 |
| 3,859,885 | 1/1975 | Hayashida | 84/436 |
| 4,248,130 | 2/1981 | Erickson | 84/434 |
| 4,574,171 | 3/1986 | Denley | 200/340 |

FOREIGN PATENT DOCUMENTS

| | | | |
|---|---|---|---|
| 514134 | 12/1930 | Fed. Rep. of Germany | 84/433 |
| 2017436 | 4/1970 | Fed. Rep. of Germany | 84/434 |
| 194536 | 8/1967 | U.S.S.R. | 84/433 |

*Primary Examiner*—Michael L. Gellner
*Assistant Examiner*—Cassandra C. Spyrou

[57] ABSTRACT

A key guide for use in a musical or other keyboard comprises a chassis (17), a bumper (16), a bushing (13) and a track (10). The bushing slides against the track during operation. Bushing support means (12) connect the bushing with the chassis and allow limited side motion of the bushing in response to side force produced during operation. The bumper is formed of a softer material than the bushing and is disposed to cushion impact of the bushing with the chassis. Means are provided to disengage the bumper from the bushing and/or the chassis when compressive side force is reversed. Various embodiments are disclosed which accommodate side force over 360 degrees and in two opposite directions. An embodiment utilizing the invention to guide an independent Janko musical keyboard key is disclosed.

17 Claims, 4 Drawing Sheets

FIG. 11a
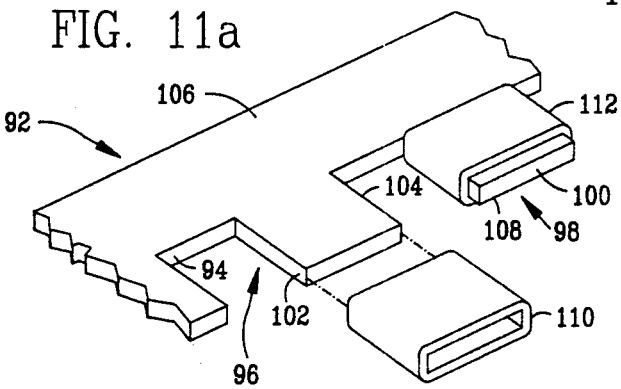
FIG. 11b
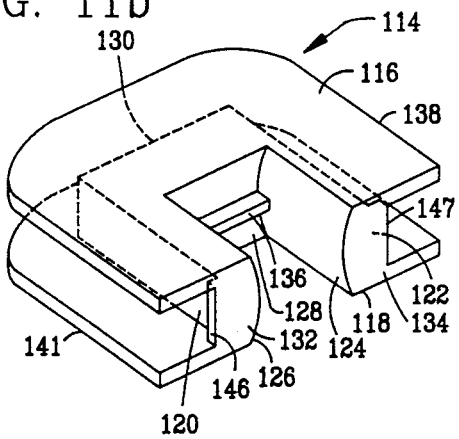
FIG. 11c
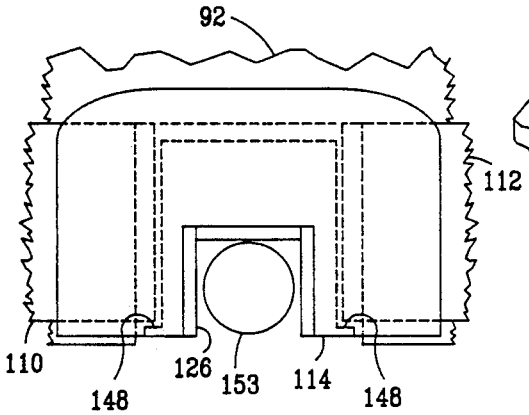
FIG. 11d
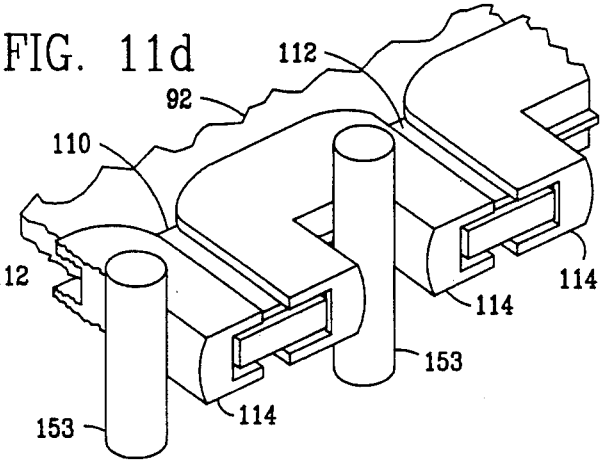
FIG. 12
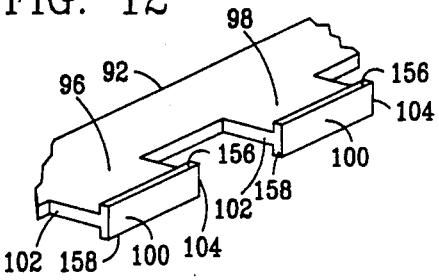
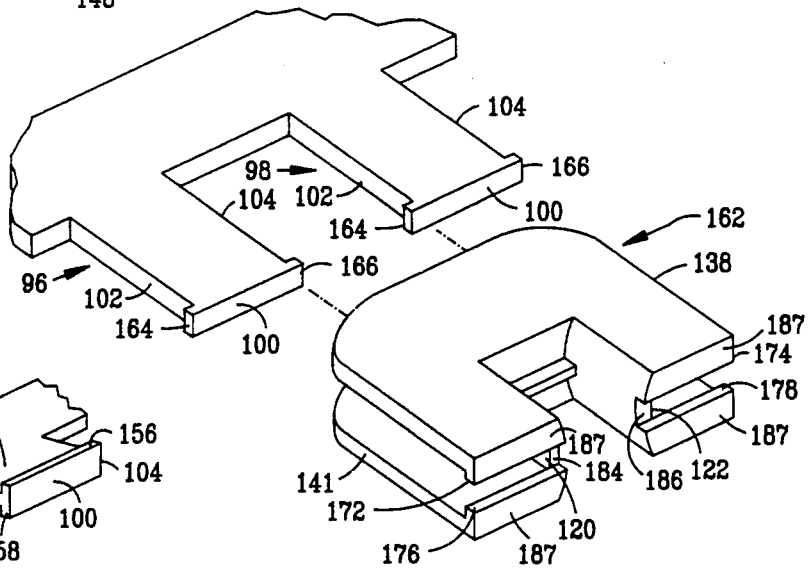
FIG. 13

KEY GUIDE

FIELD OF THE INVENTION

This invention relates to a guiding assembly for a keyboard key in a musical instrument, word processor or other finger-operated device wherein a key is reciprocated along an axis of motion by the finger of the operator. Generally, this axis is roughly vertical, but may be horizontal in certain applications, such as an accordion.

BACKGROUND OF THE INVENTION

In designing a key guide, some provision must be incorporated to restrict side-to-side movement of the key. This movement results from side force. Side force is a vector component of the overall force applied to a key. This overall force may be applied by an external source, e.g., the finger of the operator, and/or by an internal source, e.g., a return spring. Gravity also contributes to side force—particularly if the key axis of motion is not vertical or if the key is unbalanced. The side force vector component is perpendicular to the key axis of motion. Besides cancelling the side force vector, three features of operation are generally desirable in a key guide:

1. Silent operation: Silent operation is an unachieved feature when the key is mounted as in FIG. 1. The key stem designated by reference numeral 1 is inserted into a frame 2 formed of rigid yet low friction material such as nylon. The holes 3, 4 in the frame must be slightly larger than the key stem to minimize friction. Because of this clearance, or "leeway room", side force often will result in slight sideways movement of the stem. When the stem contacts the inside of one of the holes, this movement is decelerated and halted. The force exerted by the stem against the inside of the hole during this deceleration period sends a shock wave through the frame.

Since the frame is formed of substantially rigid material, the deceleration period is very brief and the resultant shock wave carries a high frequency component of relatively large amplitude. The large high frequency component is perceived audibly as a "click" sound. Since the frame may act as a sounding board, even a very slight clearance may allow sufficient wobble to produce an audible rattle during operation. Such noise is particularly undesirable when the keyboard is employed for a musical application, such as an electronic synthesizer, organ, etc.

2. Low friction: Friction increases when the noise problem is addressed as in FIG. 2. This drawing figure shows a side-view cross section of a bushing modified to reduce noise. Here the key stem 1 slides through a grommet 5 which is inserted in a hole in the frame 2. The grommet is formed of a soft material such as silicone rubber. Since the grommet absorbs much of the force of lateral impart, this design affords quieter operation that the guide shown in FIG. 1. However, since the key stem is sliding against a softer material, friction is increased. This increased friction is particularly a problem when the key is one of a row of keys in a musical keyboard. Musicians sometimes wish to play glissandos, a technique which imparts significant lateral as well as vertical force on the keys. When this lateral force results in high friction, glissandos may be difficult or impossible to perform.

A felt ring may be substituted for the rubber grommet, but this would decrease friction only slightly, if at all. Furthermore, felt introduces a new set of problems: Felt tends to wear and compact with time, and the labor cost of affixing felt would likely surpass that of inserting a grommet.

3. Stable horizontal key position: Stable horizontal key position is an unachieved feature when the friction problem is solved as in FIG. 3. Here the key stem 1 slides through a bushing 6 which is inserted in a grommet 7. The bushing is formed of a low friction material such as nylon. The grommet is formed of a soft material such as silicone rubber.

If the grommet is soft enough, and if the sound absorbtion width 8 is sufficiently wide, then rattle caused by lateral key stem motion will be minimal. However, these conditions will increase the lateral distance which the key stem may move as a result of side force. Consequently, the keyboard feels sluggish.

If the grommet 7 is engineered so that the sound absorbtion width 8 is small, allowing little lateral key movement, then the grommet will not significantly attenuate the high frequency shock wave created when the key stem 1 contacts the bushing 6.

With the aforementioned art, one cannot design a key guide which features, at once, durability, silent operation, stable horizontal key position and low friction.

DESCRIPTION OF THE INVENTION

Accordingly, an object of the present invention is to provide a key guide which substantially affords each of the desirable features set forth above. To achieve these and other desirable features, various elements are provided. The following is a basic description of these elements and the manner in which they are intended to interact.

To define the key axis of motion and to substantially limit movement of the key to this axis, a track is provided. The track may be embodied in numerous forms. The track may be attached to the frame and stationary or the track may be attached to the key and reciprocative. The track, by itself, does not comprise a novel element of the invention. The invention, and each of the desired features set forth above, may be achieved using a track which is identical in structure to a track in a prior art key guide. Examples of such applicable prior art tracks are a front guide pin on a conventional acoustic piano, a key stem on a typical computer keyboard, or a pair of inwardly facing vertical parallel surfaces on the inside front section of a modern organ key (An example of organ inner key walls employed as a track can be found in U.S. Pat. No. 2,117,002, L. Hammond).

The structural element of the keyboard which moves relative to the track along the key axis of motion is referred to in this specification as the chassis. If the track is stationary and attached to the frame, e.g., the front guide pin of a conventional acoustic piano, the reciprocative structure of the key itself comprises the chassis. If the track is reciprocative and attached to the key (as in U.S. Pat. No. 2,117,002, L. Hammond) the stationary frame of the keyboard comprises the chassis.

To make sliding contact with the track, a bushing is provided. The surface of the bushing which normally makes sliding contact with the track is referred to in this specification as the track-engaging surface. This bushing surface, and/or the entire bushing, may be formed of nylon or other material.

Bushing support means are provided to attach the bushing to the chassis and to allow slight movement of the bushing relative to the chassis along an axis perpendicular to the key axis of motion. The bushing support means may be embodied in numerous forms, some of which are detailed below in the preferred embodiments section. The bushing and the bushing support means may be incorporated into a unitary structure.

A bumper is provided to cushion impact of the bushing with the chassis. As explained below, the bumper, in accommodating side force in the direction of engagement, engages with the bushing and chassis.

Bumper disengagement means are provided to disengage the bumper from the bushing and/or the chassis when side force in the direction of engagement is reversed. As discussed below, this disengagement may be complete or partial. The bumper surface which disengages is referred to as the disengaging bumper surface. The disengaging bumper surface is formed of a softer material than the bushing track-engaging surface. In each of the preferred embodiments described in this specification, each structural element which is defined as a bumper is entirely formed of this softer material. Felt and rubber are examples of softer materials which may be used. The bushing support means and the bumper may be incorporated into a unitary structure.

The features which are believed to be novel and characteristic of this invention are set forth with particularly in the appended claims. The invention itself, however, both as to its organization and mode of operation, will be best understood from the following description taken in connection with the accompanying drawings. This description and these drawings illustrate, by generalized description and by way of example only, some, but not all, of the ways by which the invention may be conceptualized and embodied.

In the drawing figures, like reference numerals denote parts which are structurally similar and/or functionally analogous.

FIGS. 4–7 show generalized representations of some of the possible variations of elements which comprise the invention. In most applications of the invention as envisioned by the inventor, side force in at least two opposite directions perpendicular to the key axis of motion must be accommodated by the guide assembly. The complete guide assembly in these applications, viewed in cross section, would generally include two sets of the same elements mounted in mirrored relation, as in FIGS. 5 or 6. As one half of the guide assembly is accommodating side force, the other half is not.

To avoid confusion, explanation of the invention's basic operation is made with reference to FIG. 4*a–c*. The guide shown in these three figures is capable of accommodating side force in one direction only.

The side force direction which causes bumper engagement is referred to as the direction of engagement. The side force direction which causes bumper disengagement is referred to as the direction of disengagement.

If the chassis 17 in FIG. 4*a–c* is stationary, the direction of engagement is rightward and the direction of disengagement is leftward. If the track 10 is stationary, these directions are reversed.

Referring to FIG. 4*a*, the bushing-engaging surface 9 of the track 10 is disengaged from the bushing track-engaging surface 11. The bushing support means 12 flexibly attaches the bushing 13 to the chassis 17 in a position wherein the bumper-engaging surface 14 of the bushing is disengaged from the bushing-engaging surface 15 of the bumper 16. In this generalized embodiment, the bumper bushing-engaging surface 15 is the sole disengaging bumper surface.

The bumper also has a chassis-engaging surface 18 and the chassis 17 has a bumper-engaging surface 19. In this generalized embodiment, these two surfaces are affixed to each other, i.e., they are permanently engaged.

When the track moves rightward relative to the chassis, it impacts the bushing track-engaging surface as shown in FIG. 4*b*. Unlike the fixed bushing arrangement shown in FIG. 1, this impact, under normal operating conditions with an effective embodiment of the invention will produce no substantial audible sound. Since the bushing support means is flexible and offers little resistance to rightward bushing movement, the shock wave of track-bushing impact is not substantially carried to the chassis. The bushing has little mass and does not, by itself, substantially impede rightward movement of the track. Consequently, track impact with the bushing does not result in a substantial shock wave carried within the track. Thus the shock wave of track-bushing impact is almost completely isolated within the bushing. Since the bushing has little surface area, shock waves within the bushing produce no substantial audible sound.

After the track has contacted the bushing and rightward movement continues, the track and bushing remain in contact with each other and move together. Limitation of this movement begins when the bushing bumper-engaging surface 14 contacts the bumper bushing-engaging surface 15 as shown in FIG. 4*c*. Because the bumper is relatively soft, a slight amount of movement will occur after bumper contact until the side force and bumper compression force achieve equilibrium.

During this period of bumper compression, a low amplitude, low frequency shock wave is transmitted through the track 10 and chassis 17. Under normal operating conditions with an effective embodiment of the invention this wave is generally inaudible. Under special circumstances, such as rapid sideways key movement, the low frequency shock wave may be audible. If so, it is perceived by the operator as a soft "thump"—far more acceptable than the "click" of the guide in FIG. 1.

During the course of normal operation, the rightward side force eventually subsides and reverses. The track then moves leftward relative to the chassis. The bumper disengagement means is disposed to disengage the bumper from the bushing as a result of this leftward track movement. In each preferred embodiment described in this specification, the bumper disengagement means is incorporated into the structure of the bushing and/or the bumper.

Two general categories of bumper disengagement means are envisioned by the inventor: Active and Passive. The active type uses energy stored during the engagement stroke. The passive type uses energy expended during the disengagement stroke.

The bushing shown in FIG. 4*a–c* may be viewed as an example of the active type as follows: The bushing support means 12 may be comprised of a flexible strip of material which exerts leftward force on the bushing when the bushing is positioned as in FIG. 4*c*. During the disengagement stroke, this leftward force causes the bushing to disengage from the bumper. Other examples of active disengagement means, as well as passive embodiments will be described in the preferred embodiments section below.

Disengagement of the aforementioned engaging surfaces produces no substantial sound. Thus, effectively silent operation is achieved through the entire engagement-disengagement cycle.

Silent operation is enhanced when very small gaps are engineered between the various disengaging surfaces. A gap of a thousandth of an inch between the bumper and bushing is sufficient as long as the bumper disengages from the bushing during the disengagement stroke. The bumper may be engineered to allow little side movement during compression. 0.015" of compression for ten pounds of side force attenuates the high frequency shock wave component quite satisfactorily. Thus, the guide may be engineered to provide stable horizontal key position without sacrificing silent operation.

Because the track-engaging surface of the bushing is formed of nylon or similar material, the guide also provides excellent friction and wear characteristics.

The invention may be effectively embodied with alternate arrangements of the basic elements. The basic elements themselves may be altered as well. FIGS. 5–7 show some combinations of these alternatives. Other alternate features will be disclosed in the preferred embodiments section. FIGS. 5 and 6 show cross-sectional views of guides designed to accommodate side force in at least two opposite directions.

The FIG. 5 guide incorporates a track 10 which comprises at least two apositioned bushing-engaging surfaces 9. The chassis 17 is interposed between these surfaces. The bumper bushing-engaging surfaces 15 are affixed to the bushing bumper-engaging surfaces 14, i.e., they are permanently engaged. Thus, each bushing support means 12 supports a bushing 13 and a bumper 16. The bushing track-engaging surfaces 11 are convex. Each bushing support means 12 imposes a slight trackward force on its corresponding bushing 13 at all times. Thus, the bushings are always engaged with the track, allowing for reduced side-to-side key movement. The bumper chassis-engaging surfaces 18 are textured to allow reduced bumper thickness without reducing bumper compression characteristics. The texturing further serves to improve sound absorbtion by elliminating any "slap" sound which may result from a flat surface contacting another flat surface.

The FIG. 5 guide may be modified in other ways not shown, including: An additional bumper may be affixed to the bumper-engaging surface of the chassis, so that the bumper chassis-engaging surface 18 contacts a similarly soft surface. This additional bumper would provide additional cushioning and, consequently, enhanced silent operation qualities. Another possible modification, not shown, would attach the bushing support means 12 to the bumper 16 instead of the bushing 13. Also, the chassis bumper-engaging surfaces 19 may be textured instead of or in addition to the bumper chassis-engaging surfaces 18.

The FIG. 6 guide incorporates a chassis 17 with at least two apositioned bumper-engaging surfaces 19. The track 10 is interposed between these surfaces. The bushing support means 12 supports the bumper 16 as well as the bushing 13. In this embodiment, the engaging surfaces 15, 18 of the bumper each disengage on the disengagement stroke. Suspending the bumper between the bushing and chassis in this manner enhances quiet operation qualities. The bushing bumper-engaging surface 14 is textured. The bushing track-engaging surfaces 11 are split vertically to spread side force over a larger section of the track. This structure enhances angular stability of the bushing while maintaining low friction.

The FIG. 6 guide may be modified in other ways not shown, including: The bumper bushing-engaging surface 15 may be textured instead of or in addition to the bushing bumper-engaging surface 14. The bumper support means may be attached to the bushing. The bushing support means may be attached directly to the chassis.

The term "disengagement" in this specification does not necessarily refer to complete disengagement. In FIGS. 4–6 at least one bumper-engaging surface is shown to completely disengage from the bumper during the disengagement stroke. However, the desired features of the invention may be achieved in an embodiment which allows only partial bumper disengagement. A generalized diagram of such an embodiment is shown in FIG. *7a–c*.

Referring to FIG. *7a–c*, the bushing 13 and the bushing support means 12 are incorporated into a unitary structure as a strip of flexible material such as Teflon ®. When the guide is at rest, as in FIG. *7a*, this strip is in contact with the bumper 16 at point A. The bumper at point A may be viewed as a second element of the bushing support means since it plays a part in determining the position of the bushing. The bushing is in contact with the track 10 at point B. A line drawn between points A and B would not be parallel to the side force axis. As the track 10 moves in the direction of engagement, i.e., rightward relative to the chassis 17, as shown in FIG. *7b*, the bushing engages the bumper at point C.

Additional rightward movement, as shown in FIG. *7c*, may cause flattening of the bushing and engagement of the bushing with the track at points D and/or E. A line drawn between points A and D may be parallel to the side force axis. Since the bumper is thin (unlike the bumper in FIG. 3), a high frequency shock wave would be transmitted through the chassis if the track and bushing were disengaged and point D was the first point of track-bushing contact. However, since compression of the bumper and flattening of the bushing cause the bushing to impart a gradually increasing resistance to rightward track movement, contact between the track and bushing at point D does not result in a high frequency shock wave.

The various elements and features shown in FIGS. 4–7 and described with refernce to these FIGS. may be combined in numerous ways not shown.

Vertical, left-right and front-rear orientation terms are used in this specification and appended claims to facillitate description and understanding of various parts, elements and events. The use of these orientation terms is in no way intended to convey any limitation on the angle at which the herein disclosed invention and embodiments may be mounted and satisfactorily operated or on the physical orientation of the invention with respect to the operator. The invention and each of the preferred embodiments, properly engineered, may be tilted on any horizontal axis to any angle or upside down during or after assembly and still be made to operate without detriment to performance.

BRIEF DESCRIPTION OF THE DRAWINGS

In the accompanying drawings:

FIGS. 11*a–d* show various elements of an embodiment with a passive bumper disengagement means intended to accommodate side force in two opposite directions only. FIG. 11*a* is a perspective view of an explanatory nature showing a frame and two bumpers; one bumper is installed. FIG. 11*b* is a perspective view of a bushing. FIG. 11*c* is an overhead view of an assembled guide. FIG. 11*d* is a perspective view of several assembled guides.

FIG. 12 is a perspective view of a modified frame for the guide shown in FIGS. 11*a–d*.

FIG. 13 is a perspective exploded view of a frame and bushing modified from the embodiment shown in FIGS. 11*a–d*.

DESCRIPTION OF THE PREFERRED EMBODIMENTS

Conventional keyboard structures can be easily modified to incorporate the invention. The following description, which refers to FIG. 8, describes an embodiment of the invention which may be applied to a conventional acoustic piano keyboard, as well as other keyboards.

This embodiment is intended to accommodate side force in two opposite directions only. In the context of the description, these two directions are substantially left and right. To facillitate understanding, this embodiment is described in the context of its application as a guide for the front of a conventional piano key. This embodiment incorporates an active bumper desengagement means.

Figure 8:
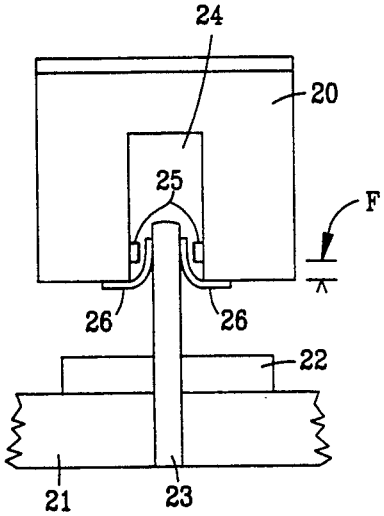
FIG. 8 is a front cross-section view of the front section of a conventional acoustic piano key modified according to one embodiment of the invention.

FIG. 8 shows a cutaway view of the front section of an acoustic piano key 20 at rest position with a guide designed according to the invention. The conventional front rail 21, felt punching 22, guide pin 23 and guide pin cavity 24 are unmodified. The guide pin serves as the track for the guide. Substituted for the felt or other prior art bushing on each side of the guide pin cavity is a bushing 25 and a bumper 26.

Each bushing 25 is comprised of a strip of flexible, low friction material. The width of each bushing may be equal to the width of the conventional bushing felt, or approximately 1 cm. The bushings may be formed of nylon, Teflon®, or other similar material. The inventor recommends 0.01" Teflon® tape, etched on one side. Manufacturers of this material include Norton Chemplast. A portion of the etched surface at one end of each bushing is affixed to the underside of the key. An unaffixed portion of each bushing 25 is turned upward into the guide pin cavity 24. When the key is installed, the guide pin 23 is interposed between the two bushings.

One bumper 26 is affixed to each of the two vertical walls, left and right, within the guide pin cavity 24. Each bumper is comprised of a strip of rubber, felt or other material. Rubber diaphram material with one center layer of fabric reinforcement is recommended. Manufacturers of this material include Built-Rite and Seimperit. The sheet is peeled in half along the cloth reinforcement. The half without the cloth is used. Thus, the bumpers are each approx. 0.025" thick. The smooth surface of each bumper is affixed to the inside of the key 20. The textured surface left over from the woven cloth pattern serves as the bushing-engaging surface and as the disengaging bumper surface. The Teflon® and the rubber may each be affixed with cyanoacrylate. The length of each installed bumper extends horizontally, front to rear. This length is substantially equal to the approx. 1 cm. width of each bushing 25. An unaffixed portion of each bushing is interposed between the track and the corresponding bumper. The bumpers and bushings are disposed substantially the same distance from the front surface of the key, i.e., the centers of the guide pin, bushings and bumpers are aligned along a left-right axis.

The height of each installed bumper 26, i.e., the width of each rubber strip, will affect its surface area and, thus, its compression characteristics. More surface area decreases compressability. Decreased compressability reduces side-to-side key wobble but increases the high frequency component of the shock wave, as discussed in the invention background section above. When the above recommended rubber diaphram material is used, a bumper height of approx. 0.1 in. has been found to be near optimum.

To reduce friction and to minimize side force on the affixed portion of the bushing 24, a non-engaging bushing portion is recommended between the affixed bushing portion and the disengaging bumper surface. A vertical distance F corresponding to this non-engaging bushing portion between the bottom edges of the bumpers and the bottom of the key is shown. This distance should be at least 0.06". Each installed bushing must extend sufficiently upward into the guide pin cavity 24 to substantially cover the bumper 26 but should not project above the top of the guide pin 23 at rest position.

Figure 7A:
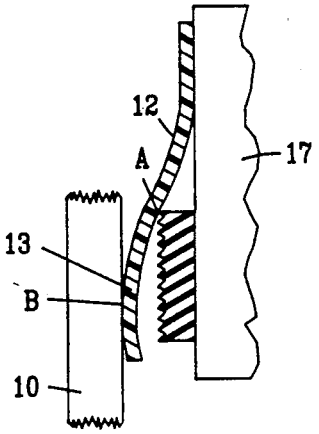
FIG. 7*a–c* is a generalized diagram showing a basic embodiment of the invention designed to accommodate side force in one direction only in various stages of compression.
Figure 7B:
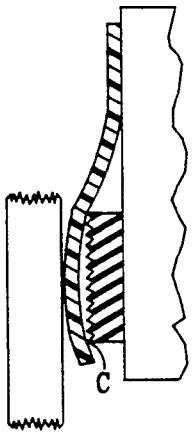
Figure 7C:
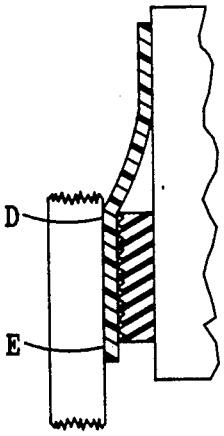

Friction is minimized when the bushings, bumpers and guide pin are engineered to allow for complete bumper disengagement as shown in FIG. 8. To achieve optimum stable horizontal key position characteristics a portion of each bumper may always remain in contact with a portion of the corresponding bushings as in FIG. 7. The effective guide pin width may be adjusted in the conventional manner by slight rotation of the guide pin so that when the key is at rest each bushing just barely makes contact with the lower edge of the corresponding bumper. With this configuration, the bumpers impart only minimal inward force on the bushings when no side force is present. Consequently, the bushings impart minimal force on the guide pin. Friction and wobble are each optimized.

As an alternative to affixing the bumper 26 to the key 20 as shown, the bumper may instead be affixed to the bushing 25. With this alternative, not shown, it is recommended that the smooth surface of the bumper be affixed to the bushing, leaving the textured bumper surface to engage and disengage with the body of the key 20. With this alternative, as with the embodiment shown, the unaffixed length of the bushing is interposed between the bumper and the track.

This preferred embodiment, including the proposed alternative bumper position, may be used in applications other than the conventional piano key front rail guide described above. For example, the two strips of flexible, low friction material and bumpers may replace balance rail bushing felts on a conventional piano keyboard. The two bushings, left and right, may be affixed to the corresponding left and right horizontal surfaces in the notch on the underside of the balance rail key button.

In the FIG. 8 embodiment, each guide includes two bumper/bushing sets, left and right, to accommodate leftward and rightward side force. The two bumpers and/or the two bushings may be incorporated into unitary structures. A basic design of the invention incorporating unitary bumper and bushing structures includes a track comprising a boom, such as a guide pin, rod or other such structure with greater length than width and with substantially parallel sides. The booms shown in FIGS. 9 and 10 have circular cross-sections. Other cross-sectional shapes may be employed instead, as discussed below. The track fits, with clearance, through a space in the bushing. The bushing attaches into a space in the bumper. The bumper attaches into a space in the frame, or chassis. As with the track cross-section and bushing space, the frame and bumper spaces may also have non-circular shapes. The bumper is adapted to allow limited bushing movement relative to the chassis in at least two opposite directions perpendicular to the key axis of motion. This movement may be effectively limited to the bushing, in which case the bushing-engaging surface of the bumper comprises the disengaging bumper surface. Alternately, the bumper may be adapted to move with the bushing, in which case the chassis-engaging surface of the bumper comprises the disengaging bumper surface. As a third alternative, the bumper may be adapted so that each of the aforementioned bumper surfaces disengage.

Figure 9:
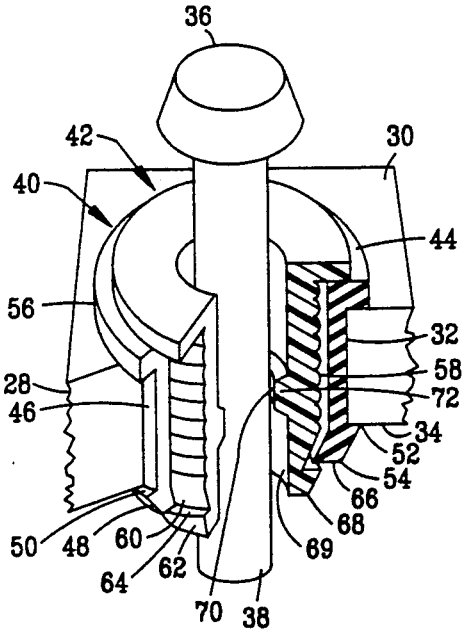
FIG. 9 is a perspective view of an embodiment of the invention incorporating a passive bumper disengagement means. The frame, bushing and bumper are cutaway to reveal structure.
Figure 10:
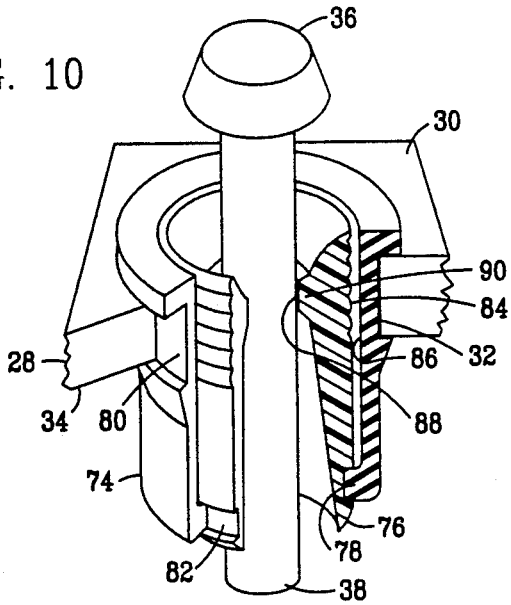
FIG. 10 is a perspective view of an embodiment of the invention incorporating an active bumper disengagement means. The frame, bushing and bumper are cutaway to reveal structure.

In the FIGS. 9 and 10 embodiments, the bushing, bumper and chassis spaces comprise holes, i.e., the spaces are defined by closed loops. This need not be the case. In the FIG. 14 embodiment, for example, the spaces in each of these three elements are open. Each of the six ($2^3$ less 2) additional combinations of open and closed elements (e.g., open space in bushing, closed space in bumper and chassis) may be embodied, not shown.

The FIGS. 9 and 10 embodiments are designed to accommodate side force over 360 degrees. The bushing, bumper and chassis spaces in these embodiments are circular in cross-section.

Referring now to FIGS. 9 and 10, the frame 28 in the area of the guide is provided with an upper surface 30 communicating through a cylindrical bore 32 with a lower surface 34. The upper and lower surfaces are horizontal and coplanar. The bore 32 has a vertical axis perpendicular to the upper and lower surfaces. The frame may be formed of a rigid material such as extruded aluminum. The key 36 is attached to a cylindrical track, or key stem 38. The key stem may be formed of nickel-plated steel or other material. The track, bushings, bumpers and frame bore are axially symmetric.

FIG. 9 shows a guide incorporating a passive type bumper disengagement means. The frame 28, bumper 40 and bushing 42 are cut-away to reveal structure.

The bumper 40 may be formed of silicone rubber or similar material. The horizontally-facing outside surface of the bumper incorporates an annular flange 44 extending horizontally at the top end, a cylindrical center portion 46 below the flange 44 and a frusto-conical portion 48 below the center portion 46. The vertical length of the center portion 46 is slighty greater than the vertical thickness of the frame 28. Prior to installation, the outer diameter of the center portion 46 is equal to or slightly larger than the inside diameter of the frame bore 32. The center portion 46 terminates at its lower end in the inside edge of a horizontal, vertically facing annular surface 50. The outside edge of this surface has a diameter slightly greater than that of the center portion and is integral with the large base 52 of the frustoconical portion 48. The lower end of the bumper comprises the small base 54 of the frusto-conical portion 48. The outer diameter of this small base is smaller than the inside diameter of the frame bore 32. The inside bore of the bumper 40 is cylindrical from the upper aperture to an elevation at or below the elevation of the large base 52 of the frusto-conical outside portion 48. From this elevation to the base of the bumper, the bore tapers to a minimum inside diameter. For installation, the bumper is inserted downwardly into the frame bore until the flange 44 contacts the upper frame surface 30 and the large base 52 of the frusto-conical portion emerges from the lower aperture of the frame bore.

The bushing 42 is tubular and may be formed of Delrin® brand of acetal resin available from E.I. du Pont de Nemours & Co. or other similar material. The horizontally-facing outside surface of the bushing 42 incorporates an annular flange 56 extending horizontally at the top end, a cylindrical main body portion 58 below the flange, a tapered portion 60 below the main body portion and a frusto-conical portion 62 below the tapered portion. The vertical length of the main body portion 58 is substantially equivalent to the vertical length of the cylindrical inside portion of the bumper. The main body portion may be knurled, as shown. The tapered portion 60 corresponds in cross-sectional shape to that of the tapered inside bumper portion. The tapered bushing portion terminates at its lower end in the inside edge of a horizontal, vertically facing annular surface 64. The outside edge of this surface has a diameter equal to that of the main body portion 58 and is integral with the large base 66 of the frusto-conical portion 62. The vertical distance between this large base and the underside of the bushing flange 56 is slightly greater than the overall vertical height of the bumper 40. The lower end of the bushing 42 comprises the small base 68 of the frusto-conical portion 62. The outer diameter of this small base is smaller than the minimum inside diameter of the bumper 40. For installation, the bushing 42 is inserted downwardly into the installed bumper until the bushing flange 56 contacts the top surface of the bumper and the large base 66 of the frusto-conical portion 62 emerges from the bottom aperture of the bumper. The diameters of the main body 58 and tapered 60 portions are slightly less than the inside diameters of the installed bumper at corresponding elevations; thus, a slight annular, horizontal clearance exists between the bushing and the bumper. The diameter of the large base 66 of the bushing frusto-conical section 62 is greater than the minimum inside diameter of the installed bumper.

Figure 1:
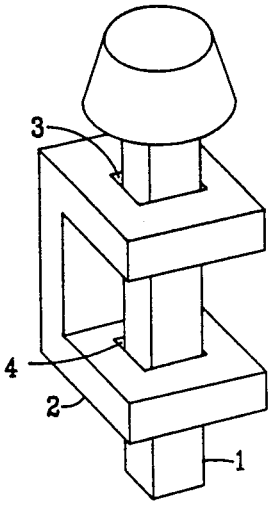
FIG. 1 PRIOR ART
FIG. 1 is a schematic diagram of a prior art key guide assembly having less than ideal noise characteristics. Two guides, an upper and lower, are shown.
Figure 2:
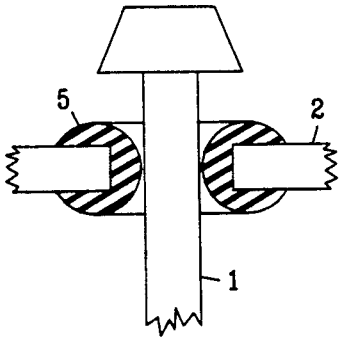
FIG. 2 PRIOR ART
FIG. 2 is a cross-section view of a single prior art key guide with improved noise characteristics but increased friction.
Figure 3:
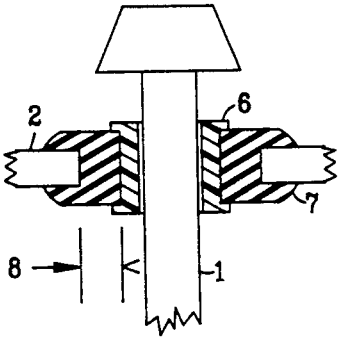
FIG. 3 is a cross-section view of a single key guide with improved noise characteristics and low friction but with less than ideal horizontal movement restricting charateristics.
Figure 4A:
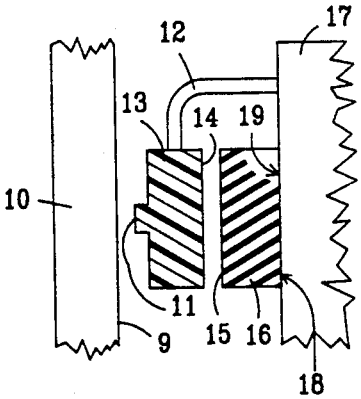
FIG. 4*a–c* is a generalized diagram showing a basic embodiment of the invention designed to accommodate side force in a one direction only in various stages of compression.
Figure 4B:
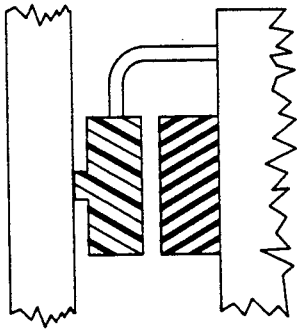
Figure 4C:
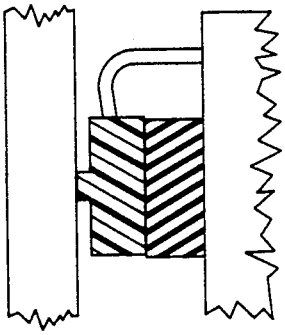
Figure 5:
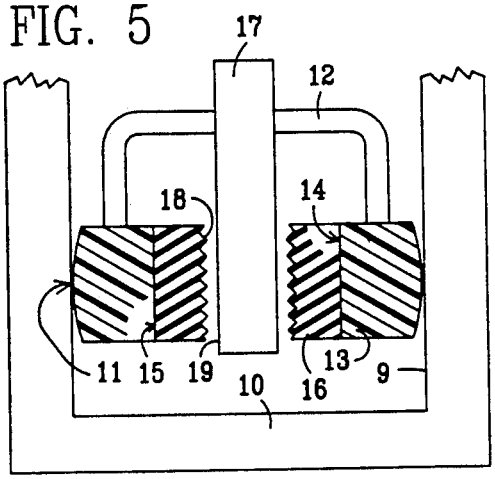
FIG. 5 is a generalized diagram showing a basic embodiment of the invention designed to accommodate side force in two directions. The chassis is interposed between two surfaces of the track.
Figure 6:
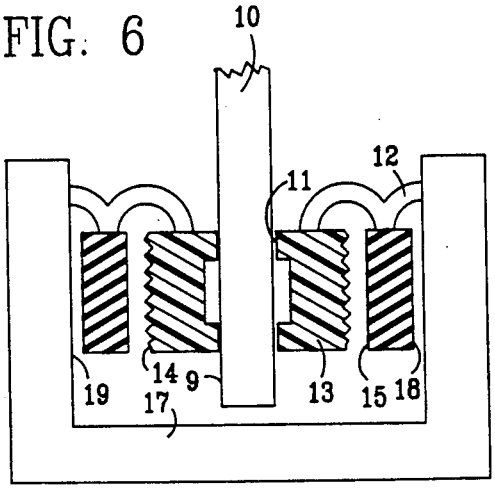
FIG. 6 is a generalized diagram showing a basic embodiment of the invention designed to accommodate side force in two directions. The track is interposed between two surfaces of the chassis.

The key stem 38 is inserted into the bore 69 of the bushing 42. The track-engaging surface shown is the inwardly facing surface 70 of an inwardly projecting annular flange 72 inside the bore of the bushing. The inside diameter of this flange comprises the minimum inside diameter of the bushing and is very slightly larger than the diameter of the key stem 38. The elevation of this flange 72 when bumper 40 and bushing 42 are installed is substantially equal to the elevation halfway between the top surface 30 and the bottom surface 34 of the frame 28. Alternately, the flange 72 may be dispensed with and the entire inside surface of the bushing may comprise the track-engaging surface. Other alternate track-engaging surface shapes, including those shown in FIGS. 5 and 6 may be employed as well.

As another alternative, the bumper 40 may be formed with inside diameters less than or equal to the outside bushing diameters at corresponding elevations and the frame bore diameter may be slightly larger than the outside diameter of the center bumper exterior portion 46 with bushing 42 installed. With this alternative, not shown, the center bumper exterior portion comprises the disengaging bumper surface.

FIG. 10 shows a guide incorporating an active type bumper disengagement means. The frame 28, bumper 74 and bushing 76 are cut-away to reveal structure.

In this embodiment, the bumper 74 is tubular and may be formed of silicone rubber or similar material. An inwardly extending annular flange 78 is incorporated into the lower end of the bumper. On the outside of the upper end of the bumper an annular slot 80 is incorporated. The vertical thickness of this slot is equal to or slightly larger than the vertical thickness of the frame 28.

For installation, the bumper 74 is first inserted into the frame bore 32 so that the frame 28 rests within the bumper slot 80. The inside diameter of the slot on the uninstalled bumper is substantially equal to or slightly larger than the diameter of the frame bore.

The bushing 76 is tubular with an annular slot 82 extending inwardly from the outside surface at the lower end. The inside diameter of this slot is very slightly larger than the inside diameter of the bumper flange 78 prior to bushing installation. The vertical width of this slot is substantially equal to the vertical width of the bumper flange. The bushing may be formed of Delrin® or similar material.

After the bumper is installed in the frame, the bushing is downwardly inserted into the bumper until the bumper flange rests within the bushing slot.

The horizontally-facing outside surface of the installed bushing in the area of equal elevation with the frame comprises the bushing bumper-engaging surface 84. The outside diameter of the bushing in this area is very slightly smaller than the inside diameter of the installed bumper in the area of equal elevation with the frame. Thus, in this area, a slight annular clearance exists between the bumper and bushing. The inside surface of the bumper in this area comprises the disengaging bumper surface 86. The bushing in this area may be knurled, as shown, or otherwise textured.

The key stem 38 is inserted into the bore of the bushing 76. The track-engaging surface shown is the inwardly facing surface 88 of an inwardly projecting annular flange 90 inside the bore of the bushing. The inside diameter of this flange comprises the minimum inside diameter of the bushing and is very slightly larger than the diameter of the key stem. The elevation of this flange 90 when bumper 74 and bushing 76 are installed is substantially equal to the elevation halfway between the top surface 30 and the bottom surface 34 of the frame 28.

The inside diameters of the installed bumper 74 above the bumper flange 78 are larger than the outside installed bushing diameters at corresponding elevations. A portion of the length of the bumper between the bumper flange and the bumper slot 80 is sufficiently thin that slight side force of the key stem 38 on the bushing track engaging surface 88 will result in slight deformation of this thin section of the bumper and bushing contact with the disengaging bumper surface 86.

Because the thin section of the bumper deforms easily, the bumper offers little resistance to lateral movement of the track-engaging end of the bushing. Thus, the shock wave of key stem/bushing impact is almost completely isolated within the bushing. When side force is reversed and the center of the key stem moves toward the center of the frame bore, the bumper disengages the bushing from the disengaging bumper surface.

The guides shown in FIGS. 9 and 10 may each be modified in numerous ways including the following: The key stem, bushing, bumper and frame bore may formed of a different horizontal cross-sectional shape than the circular one shown. For example, a triangular or square shape may be used. These and other alternate shapes would prevent rotation of the key around a vertical axis. Also, the bumper bushing-engaging surfaces may be knurled or otherwise textured.

The guides shown in FIGS. 11–14 are embodiments with passive bumper disengagement means intended to accommodate side force in two opposite directions only. In this specification, these two directions are left and right. These guides include two projections on the chassis, each projection extending outwardly substantially the same distance and in substantially the same direction. Each projection incorporates a bumper-engaging surface. The two bumper-engaging surfaces are apositioned. The bushing is roughly "U" shaped and is interposed between these two bumper-engaging surfaces. The track is inserted between the two beams of the bushing.

The frame 92 in the area of the guide is formed of a rigid material such as extruded aluminum. The frame incorporates a linear edge 94, a left projection 96 and a right projection 98. The linear edge extends along the distance between the two projections. The two projections may be substantially identical in size and shape. Each projection extends outwardly substantially the same direction and in the same direction from the linear edge 94. Each projection incorporates the following surfaces, which may each be flat: a front 100, a left 102, a right 104, a top 106 and a bottom 108. The left and right surfaces are parallel to each other: as are the top and bottom. The left surface of the right projection 98 and the right surface of the left projection 96 are the bumper-engaging surfaces and are apositioned. The front, top and left surfaces are at right angles to each other. The angle formed by the linear edge 94 and each side surface of each projection is substantially 90 degrees. The preceding frame features are common to the guides in FIGS. 11–14.

Each of the bumper-engaging chassis (or frame) surfaces engages a bumper. Means are provided to limit movement of these bumpers in the following directions: outward (forward), inward (rearward) and parallel to the key axis of motion. These bumpers may each be affixed to their respective chassis or bushing surfaces with adhesive, not shown. In these embodiments, the adhesive comprises the means for limiting movement in each of the aforementioned directions. Other bumper movement limiting means are disclosed and shown below. In each of the following embodiments the linear edge 94 comprises the inward (rearward) bumper movement limiting means.

Referring now to FIG. 11, two ring-shaped bumpers, left 110 and right 112, are provided. Rubber bands of the proper width, length, thickness and composition may be used. One bumper is wrapped around each projection and is thereby installed. The length (circumferance) of each bumper is slightly less than double the height plus width of each projection so that each bumper does not fit loosely around its projection. Each bumper is installed with one edge flush against the linear edge 94 of the frame 92. The depth of each installed bumper is less than the forward distance which each projection extends. Thus, an area at the front of the top, bottom and sides of each projection remains uncovered. Each installed bumper, with its ring shape, comprises its own means for limiting bumper movement parallel to the key axis of motion.

A bushing 114 is installed between the two bumpers 110, 112. The bushing may be formed of Delrin® or similar material. The bushing is horizontally disposed with the base of the "U" to the rear and the two beams of the "U" pointing in substantially the same direction as the two projections 96, 98 (forward). The following bushing surfaces are provided, catagorized into three sets by semicolon: a top 116, a bottom 118; a left 120, a right 122, an inside right 124, an inside left 126; an inside rear 128, a rear 130, a left front 132 and a right front 134. Surfaces of the same set are substantially parallel to each other. The three sets are substantially disposed at right angles to each other.

The distance between the left 120 and right 122 bushing surfaces is very slightly less than the distance between the leftmost surface of the installed right bumper 112 and the rightmost surface of the installed left bumper 110.

The left and right inside surfaces 126, 124 are each convex along a horizontal axis halfway between the top 116 and bottom 118 surfaces. The rear inside surface 128 incorporates a forwardly projecting horizontal ridge 136 positioned halfway between the top and bottom surfaces.

The bushing 114 incorporates two horizontal support flanges: a top 138, and a bottom 141 to hold the bushing in vertical position and to enhance structural rigidity. Each support flange is roughly "U" shaped and projects horizontally from the left 120, rear 130, and right 122 sides of the bushing. The top flange is adjacent to the top surface 116; the bottom flange is adjacent to the bottom surface 118. The sideward distance which each support flange projects from the left and right sides is greater than the thickness of an installed bumper. The height of the space between the support flanges opposite the left and right bushing sides is greater than the distance between the top and bottom surfaces of an installed bumper. Because the rear portion of each support flange serves only to enhance structural rigidity, one or both of these portions may be truncated or eliminated to allow space for other parts of the keyboard, not shown. If both of these rear portions are eliminated, then the bushing is left with a pair of apositioned support flanges projecting distally (i.e., horizontally, in the context of this description) from each beam of the bushing.

To prevent the rear bushing surface 130 from directly contacting the linear edge 94 inward bushing movement limiting means are provided. These means may comprise at least one retaining flange extending laterally substantially adjacent the front, or beam end, surfaces 132, 134 of the bushing 114. These surfaces may include the front edges of the support flanges, i.e., the retaining flanges may extend from one or more of the support flanges as shown in FIG. 13 and/or from one or both of the main body portions of each beam as shown in FIG. 11. The lateral distance which each flange projects is slightly less than the thickness of an installed bumper. The bushing shown in FIG. 11 incorporates two vertical retaining flanges, left 146 and right 147. To ensure that the rear surface 130 of the bushing does not contact the linear edge 94 of the frame 92, the distance between the rearward side surface 148 of each retaining flange 146, 147 and the rear surface of the bushing is less than the depth of the installed bumper. If two or more retaining flanges are employed, one on each side of the bushing (as in each embodiment shown), then the retaining flanges may also serve as a means to limit outward (forward) creeping, or movement, of the bumpers.

After the bumpers 110, 112 are installed, the bushing 114 is installed by rearward insertion into the space between the two bumpers so that the two beams of the "U" are pointed in substantially the same direction as the frame projections. Each bumper is interposed between the corresponding pair of support flanges.

After bushing installation, a cylindrical track 153 is inserted into the space between the inside left 126 and inside right 124 bushing surfaces. The diameter of the track is slightly less than the minimum distance between the inside right and left surfaces. Cross-sectional shapes other than circular, e.g., rectangular, may be used for the track.

The track 153 is attached to a key, not shown. Other guide means, not shown, substantially prevent track movement within the front-to-rear axis. Thus, forward movement of the bushing 114 is limited when the horizontal ridge 136 contacts the rear of the track. The position of the installed track within the front-to-rear axis allows a slight gap between the rearward side surface 148 of each vertical flange 146, 147 and the front edge of each corresponding bumper 110, 112 when this ridge-track contact is made and when each bumper is touching the linear edge 94.

Figure 15:
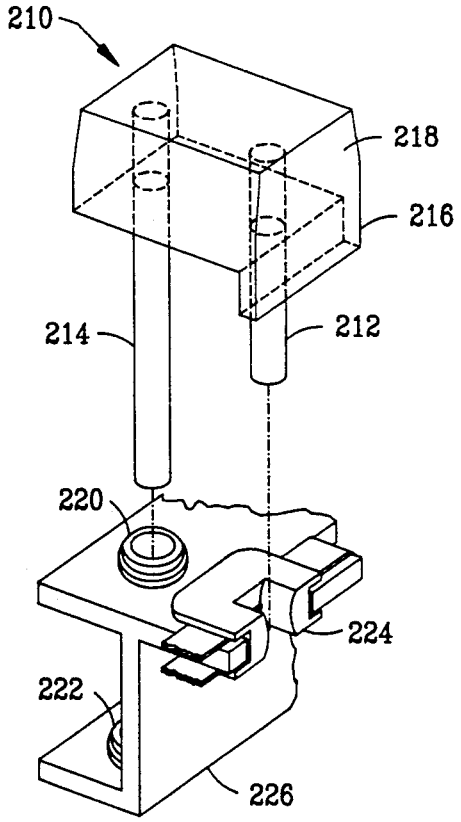
FIG. 15 is a perspective exploded view of an independent Janko key and guide constructed according to a preferred embodiment of the invention.

This guide, properly engineered, meets the desirable features criteria set forth in the background section above quite satisfactorily. Furthermore, tooling costs are minimal: "Off the shelf" materials may be used for the track and bumpers. The frame projections may be formed by punching or sawing the material between them, or may be molded. The bushing may be injection formed with a simple two-part mold. A further advantage of this guide is that it allows a key structure in close proximity forward of the track to travel vertically at the same elevation as the bushing without obstruction. One example of the value of this advantage is seen in FIG. 15.

FIG. 12 shows a modified frame cross-section for the FIG. 11 guide. Two horizontal flanges, upper 156 and lower 158 are incorporated into each projection 96, 98. Each of these flanges extends from the left surface 102 to the right surface 104 and is adjacent to the front surface 100. The upper flanges project upward; the lower flanges project downward. To allow bushing insertion, the vertical distance from the bottom of the lower flange 158 to the top of the upper flange 156 is less than the height of the space between the support flanges 138, 141 opposite the left 126 and right 124 bushing sides.

The purpose of these flanges 156, 158 on the frame projections is to provide an alternate means of preventing outward (forward) creeping of the bumpers 110, 112. With these flanges holding the bumpers in horizontal position, the guide may be engineered so that the horizontal ridge 136 is never making track 153 contact at the same time one or more of the vertical retaining flanges 146, 147 are making bumper contact. Thus, friction is reduced.

The frame shown in FIG. 12 may be manufactured inexpensively. If the frame is formed of extruded aluminum, the flanges 156, 158 as part of the frame cross-section, may be engineered during manufacture of the extrusion die.

FIG. 13 shows another modified frame shape and a bushing 162 adapted to accommodate this modification. Bumpers are not shown. To limit outward (forward) bumper creep, two posts, a left 164 and a right 166 are incorporated into each projection 96, 98. The left post projects leftward from the left surface 102 adjacent the front surface 100. The right post projects rightward from the right surface 104 adjacent the front surface. The sideward distance which each post projects is less than the thickness of an installed bumper.

To limit rearward bushing movement, the vertical retaining flanges 146, 147 shown in FIG. 11 are replaced with four horizontal retaining flanges: upper left 172, upper right 174, lower left 176 and lower right 178. Each retaining flange is mounted on the inside horizontal surface of its corresponding bushing support flange 138, 141 adjacent the front surfaces 184, 186. Upper retaining flanges project downward; lower retaining flanges project upward. Each retaining flange extends sideward from its corresponding bushing side 120, 122 to the sideward edge of its corresponding bushing support flange.

The inside bushing surfaces may be notched, as shown, so that the horizontal surfaces of the retaining flanges may extend to the inside bushing surfaces. With this notch, the front bushing surfaces between the retaining flanges, left 184 and right 186 are set rearward of the other front bushing surfaces 187.

The frame projections shown in FIG. 13 may be formed by punching the material between them or may be injection molded. The bushing shown in FIG. 13 may be injection molded with a two-part mold.

Figure 14:
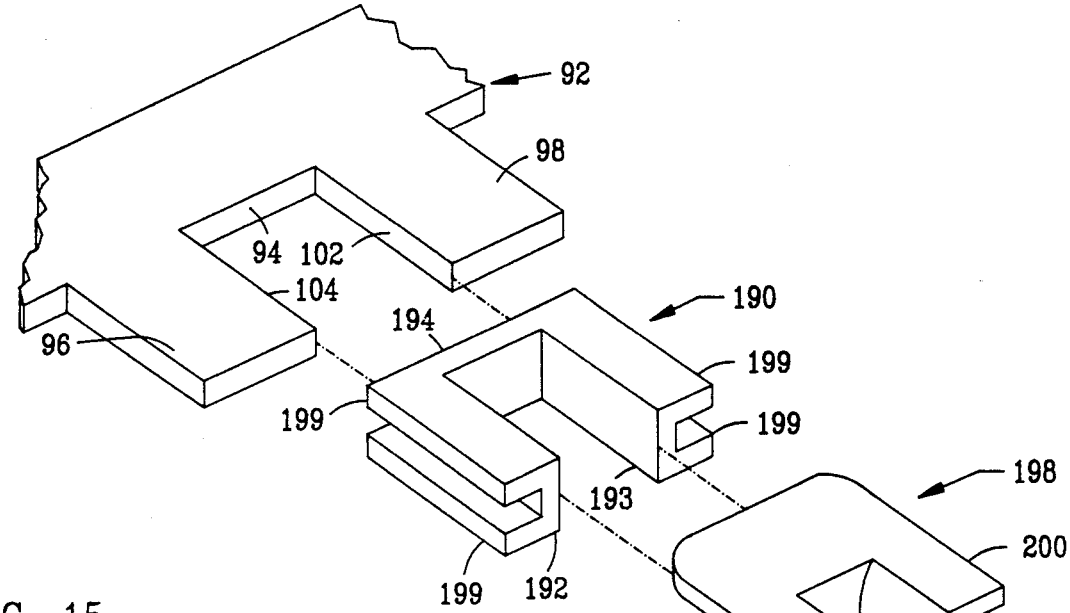
FIG. 14 is a perspective exploded view of an alternate embodiment of a guide with a passive bumper disengagement means.

FIG. 14 shows a variation on the FIG. 11 guide with a "U" shaped bumper 190 comprising a left beam 192, a right beam 193, and a base 194. The left beam fits between the left bushing side 195 and the right surface 104 of the left projection 96; the base 194 fits between the rear bushing side 196 and the linear edge 94; and the right beam 193 fits between the right bushing side 197 and the left surface 102 of the right projection 98. The sum lateral thickness of the left and right bumper beams is slightly less than the difference of the distance between the two aforementioned projection surfaces and the distance between the left and right bushing surfaces; thus, the bumper allows slight left-right movement of the installed bushing.

In this embodiment, the base 194 of the bumper 190 comprises the means for limiting outward (forward) bumper movement and inward (rearward) bushing 198 movement. Thus, the bushing retaining flanges 146, 147, 172, 174, 176, 178 shown in FIGS. 11 and 13 may be dispensed with.

Bumper support flanges 199 may be incorporated into the bumper 190 as shown to limit vertical bumper movement and to enhance silent operation by preventing the bushing support flanges 200 from contacting the frame projections 96, 98. In this embodiment, each bumper beam incorporates a pair of apositioned support flanges 199 projecting distally. The bumper may be injection formed.

The bumper support flanges 199 may be dispensed with. In this embodiment, not shown, the bushing support flanges 200 comprise the means for limiting vertical bumper movement. With the elimination of the bumper support flanges, the bumper may be manufactured inexpensively by an extrusion and cutting process.

The bumpers and bushings shown in FIGS. 11–14 are bilaterally symmetrical—both horizontally and vertically. This symmetry facillitates the assembly process, since these parts may be installed either of two ways. The bushing bumper-engaging surfaces 195, 197 may be textured as shown in FIG. 14.

The guides shown in FIGS. 9–14 may, as suggested earlier in this specification, be employed with a stationary track and reciprocating frame. In such an embodiment, not shown, each key would be attached to its own independent frame, or chassis, instead of to the track.

The embodiment shown in FIG. 15 relates to the Janko musical keyboard. This keyboard is described in U.S. Pat. No. 360,255 and others. On the Janko Keyboard, three keys are assigned to each note. Traditionally, these three keys are connected into a single assembly; when one key is depressed, the other two move downward as well. Numerous advantages are offered by separating these three keys so that each may move independently.

FIG. 15 shows the FIG. 9 and FIG. 11 embodiments applied to guide an independent Janko Keyboard key 210. The key may be machined of numerous materials or molded of epoxy or thermoplastic. Two guide pins, a front 212 and a rear 214 are provided. These pins may, as recommended, be formed of nickel-plated steel. Approx. one cm. at the top end of each guide pin is firmly embedded in the body of the key. The two guide pins are parallel to each other and project downward from the underside of the key. A guard flange 216 extends downward from the underside of the key adjacent the front surface 218 to prevent a finger depressing keys on the next lower row from getting caught underneath.

The rear guide pin 214 passes through two guides, an upper 220 and a lower 222, of the type shown in FIG. 9. The FIG. 10 guide may be used alternately, not shown. A substantial vertical distance separates these two guides. The inventor recommends approximately 4 cm. The lower guide 222 may be turned upside down relative to the upper guide 220, as shown, and installed from below via upward insertion.

The front guide pin 212 passes through one guide 224 of the type shown in FIG. 11. The structures shown in FIGS. 12, 13 or 14 may be used alternately, not shown.

The three guides are mounted in a frame 226. The frame may be formed of extruded aluminum. The front guide and the top rear guide may be placed at substantially the same elevation, as shown.

Not shown are several elements of the keyboard which may be deemed essential such as: key return means, upper and lower limit-of-travel means, and vertical key position sensing means.

The FIG. 15 embodiment may be engineered to provide exceptionally low wear, low noise, low friction and stable horizontal position characteristics at low manufacturing cost. If the guard flange 216 is eliminated, not shown, the front guide pin 212 may be positioned near flush with the front key surface 218. Thus, the horizontal distance separating the two guide pins may be maximized, minimizing key wobble.

The FIG. 15 embodiment may be applied to non-Janko keyboards or modified Janko keyboards as well.

I claim:

1. In a keyboard for a finger-operated device, the keyboard incorporating at least one key which is reciprocative along a key axis of motion and which is subject to side force in two opposite directions along at least one axis, the side force axis being perpendicular to the key axis of motion, the two side force directions comprising a direction of engagement and a direction of disengagement, a key guide comprising:

a track, a chassis, a bumper interposed between the track and the chassis, bushing support means attached to the chassis, a bushing attached to the bushing support means and interposed between the bumper and the track, bumper disengagement means, a bushing-engaging surface on the track, a track-engaging surface on the bushing, a bumper-engaging surface on the bushing, a bushing-engaging surface on the bumper, a chassis engaging surface on the bumper, a bumper-engaging surface on the chassis.

at least one of the aforementioned bumper surfaces formed of a softer material than the bushing track-engaging surface wherein, the bushing support means is structured to allow movement of the bushing relative to the chassis in each direction of side force, at least a portion of the aforementioned softer material bumper surface is disposed to engage one of the bumper-engaging surfaces as a result of side force in the direction of engagement and, the bumper disengagement means is disposed to disengage at least said portion of said softer material bumper surface as a result of side force in the direction of disengagement.

2. A key guide as in claim 1 wherein the bushing and the bumper disengagement means are incorporated into a unitary structure.

3. A key guide as in claim 1 wherein the bushing support means and the bumper disengagement means are incorporated into a unitary structure.

4. A key guide as in claim 1 wherein the bumper and the bumper disengagement means are incorporated into a unitary structure.

5. A key guide as in claim 1 wherein the bushing support means and the bushing are incorporated into a unitary structure.

6. A key guide as in claim 1 wherein the bushing support means and the bumper are incorporated into a unitary structure.

7. A key guide as in claim 1 wherein the bushing bumper-engaging surface is substantially textured.

8. A key guide as in claim 1 wherein said softer material bumper surface is substantially textured.

9. A key guide as in claim 1 wherein the chassis bumper-engaging surface is substantially textured.

10. A key guide as in claim 1 wherein, the bushing comprises a strip of flexible, low friction material, with a portion of the bushing affixed to the chassis, and an unaffixed portion interposed between the track and the bumper.

11. A key guide as in claim 10 further comprising a non-engaging bushing portion between the affixed bushing portion and the disengaging bumper surface.

12. A key guide as in claim 1 wherein, the chassis, bumper and bushing each incorporate a space, the track comprises a boom which fits, with clearance, through the bushing space, the bushing attaches into the bumper space, the bumper attaches into the chassis space, and the bumper is adapted to allow limited bushing movement relative to the chassis in at least two opposite directions perpendicular to the key axis of motion.

13. A key guide as in claim 12 wherein, each of said spaces is defined by a closed loop.

14. A key guide as in claim 12 wherein, each of said spaces is circular in cross-section.

15. A key guide as in claim 1 including, two projections on the chassis, a bumper-engaging surface on each projection, the two bumper-engaging surfaces being apositioned, and a roughly "U" shaped bushing interposed between said bumper-engaging surfaces wherein, the track is inserted between the two bushing beams.

16. A key guide as in claim 15 wherein, the bushing is horizontally and vertically bilaterally symmetrical.

17. A key guide as in claim 15 wherein, the bumper is horizontally and vertically bilaterally symmetrical.

* * * * *